US006367782B1

(12) United States Patent
Guetersloh

(10) Patent No.: US 6,367,782 B1
(45) Date of Patent: Apr. 9, 2002

(54) WATER DISTRIBUTOR

(75) Inventor: Timothy L. Guetersloh, Deerfield, WI (US)

(73) Assignee: Research Products Corporation, Madison, WI (US)

( * ) Notice: Subject to any disclaimer, the term of this patent is extended or adjusted under 35 U.S.C. 154(b) by 0 days.

(21) Appl. No.: 09/660,518

(22) Filed: Sep. 12, 2000

(51) Int. Cl.[7] ..... B01F 3/04

(52) U.S. Cl. ..... 261/106; 261/DIG. 15; 239/553.5

(58) Field of Search ..... 261/97, 103, 106, 261/110, DIG. 15; 239/379, 553.5; 137/561 A; 126/113

(56) References Cited

U.S. PATENT DOCUMENTS

| | | | | |
|---|---|---|---|---|
| 2,947,452 A | | 8/1960 | Frohmader et al. | |
| 3,570,822 A | * | 3/1971 | Peterson et al. | 261/106 |
| 3,975,470 A | | 8/1976 | Engel | |
| 4,125,576 A | | 11/1978 | Kozinski | |
| 4,158,679 A | | 6/1979 | Yeagle | |
| 4,347,197 A | | 8/1982 | Cox | |
| 4,460,520 A | * | 7/1984 | Wrightson | 261/106 |
| 5,061,407 A | * | 10/1991 | Nutter | 261/97 |
| 5,211,891 A | | 5/1993 | Anoszko | |
| 5,851,444 A | | 12/1998 | Hansell, Jr. et al. | |
| 5,853,625 A | | 12/1998 | Kensok et al. | |
| 5,932,148 A | | 8/1999 | Hansell, Jr. et al. | |
| 5,971,366 A | * | 10/1999 | Smith | 261/106 |

* cited by examiner

*Primary Examiner*—C. Scott Bushey
(74) *Attorney, Agent, or Firm*—Andrus, Sceales, Starke & Sawall, LLP

(57) ABSTRACT

A water distributor provides a uniform supply of water to an evaporative panel held in a frame of an evaporative apparatus. The water distributor includes a base having a plurality of flow channels, each of the flow channels having an inlet port for receiving water from a source, an outlet port for delivering water to the evaporative panel and a tortuous path connecting the inlet port with the outlet port for providing high flow resistance so as to facilitate the consistent and even flow of water through each of the outlet ports. The volumetric flow velocity of the water is controlled within a desired range at normal water supply pressures.

23 Claims, 10 Drawing Sheets

90
96
94
88
86
36
76
84
70
5B
78
74
72
92
100
101
22
91
20

104
90a
92a
104
76a
76a
76a
76a
76a
76a
104
72a
110
108
70a
104
102

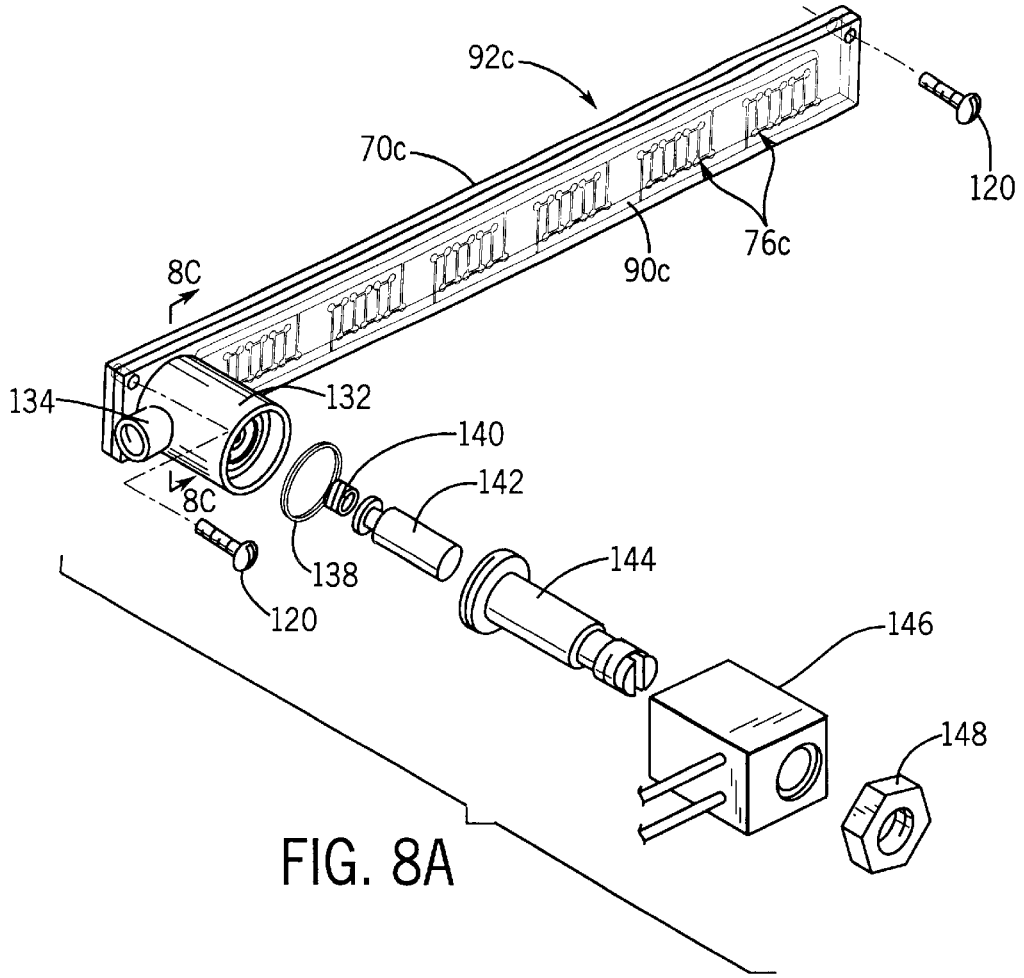
FIG. 8A
FIG. 8B
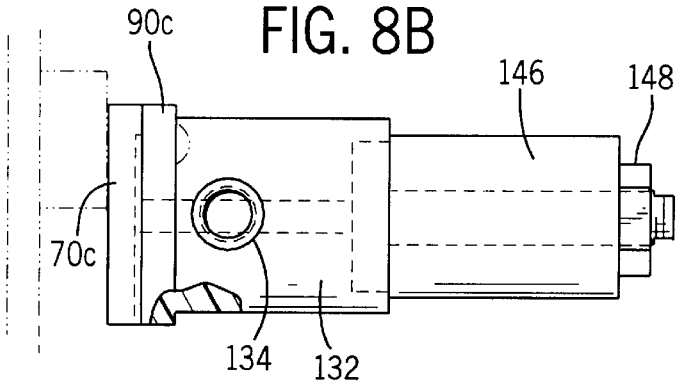
FIG. 8C
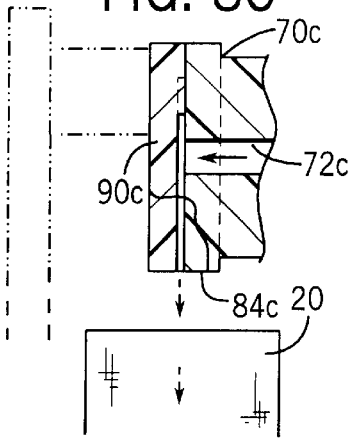

92d
150
114
90d
153
154
135
70d
84d
152

112
114
96
138

152
9B
92d
76d
9B
96
90d
150
78d
154
154
70d

WATER DISTRIBUTOR

FIELD OF THE INVENTION

This invention relates broadly to apparatus for contacting large surfaces of a liquid, such as water, with a gas, such as air, for the purpose of humidifying air. More particularly, it refers to an improved means for the uniform distribution of water to an evaporative element in such an apparatus.

BACKGROUND OF THE INVENTION

The humidification of dry air normally occurring in buildings during the winter heating season by the evaporation of water therein, depends upon the efficient evaporation of water from the continuously wetted surfaces of an evaporative element or pad as, for example, an interstitial body having extensive surfaces to provide a large area of contact of the air with water. The air to be humidified is forced through the openings of the element where it contacts the wet baffles or fibers of which the evaporative element is composed. Exposure of relatively large water surfaces in this way results in the evaporation of large amounts of the water.

An example of this type of evaporating apparatus is disclosed in the assignee's U.S. Pat. No. 5,211,891 issued May 18, 1993. In this apparatus, the humidifier includes a base portion and a removable cover. An evaporative pad or water panel is removably disposed within the base. A water feed tube is connected to a solenoid valve equipped with a small orifice for controlling the flow of water therethrough and supplies water to a trough-like distribution tray. The water flows by gravity from the distribution tray through openings and down through the water panel. Air is forced through the water panel and the air evaporates water on the water panel and humidified air is delivered to the house, building or heated space. The evaporative water panel is held within a frame mounted in the base portion in order to reduce the air bypass around the water panel, and to contain mineral deposits that build up on the water panel as a result of the evaporative process.

A typical prior art distribution tray is a plastic reservoir 0.875 inches deep which spans the top of a water panel. Within the reservoir are six cylindrical towers with V-shaped metering weirs intended to evenly spread the water to six places on the top of the water panel. The interior of this distribution tray is coated with a spray adhesive and pumice powder in the hopes of improving the evenness of the water metering. This pumice coating process is a very undesirable manufacturing step. It is labor intensive, messy and very hard toontrol, so that the coating evenly cogs all parts. When the coating is not uniform, the metering rate of individual weirs is not equal. By design, the distribution tray must be relatively large to contain an adequate water level for the metering weirs to function. This directly effects the cost of the part and indirectly the cost of the humidifier as a whole since the humidifier must be sized to contain the distribution tray. This larger size effects versatility in installation of the humidifier, since more space is required.

Another critical problem arises during installation. Weir-type metering systems are very sensitive to being mounted level. That is, the plane of the upper surface of the distribution tray should be parallel to the earth's horizon. If mounted at an angle, water will be deeper at one weir than the others and water flow will be uneven. In some cases, all the water may flow out only the lowest weir. Non-uniform shape of the individual metering weirs is another major problem. In manufacture, the weir is effected by molding flash, trimming of flash, warpage of plastic, and uneven coating of pumice. In actual use, mineral deposits may change the shape, cleaning can scrape away some of the pumice coating, or the pumice coating erodes away in some water conditions. When the metering weir is not uniform, water is not evenly distributed to the water panel. Another problem with the prior art distribution tray is its slow response time. When the humidifier turns on, it takes about 30 seconds for enough water to fill the distribution tray for the metering weir to begin supplying water to the water panel. Yet another problem is that the metering forces of a weir design are very low and easily disturbed to cause uneven flow. The operating pressure from the reservoir water level is only about 0.014 psi when all six weirs are functioning. This low pressure is within a realm of molecular water forces such as surface tension and capillary force. The metering rate is thus easily disturbed. When one weir does not start or stops flowing, the reservoir water level rises slightly and flow diverts to the remaining weirs. The pressure increase on the blocked weir is only about 10%, so there is very little force increase to encourage the weir to restart. Even if all but one weir is blocked, the pressure increases to only about 0.033 psi, still not enough to encourage blocked weirs to restart.

All of the above problems degrade the performance of humidifiers. Evaporation from the humidifier water panel is best when it is evenly covered with an adequate supply of water. Uneven distribution of water can lead to loss of wetted surface in the water panel and reduced evaporation.

Most competitor humidifiers are using variations of the weir. Different weir shape, placement, and materials are used. Some use surface textures or die cut wicking materials in place of pumice coating. All of these have the same drawbacks as the systems described above. One design lets the water stream from a single nozzle drop onto a series of ribs which divide the flow and guide each resulting stream to an outlet hole. This method takes up about the same space and has part costs similar to the prior art system. It also has low control forces and flow might easily be made to distribute unevenly. Other competitors avoid the distribution system by dipping the evaporator media in a reservoir. Stationary versions rely on wicking ability of media. These are not currently used on furnaces and performance is weak unless a recirculating pump is added with a high flow rate distributor. Dynamic systems form evaporator media in a wheel or drum shape that rotates through a reservoir to wet out. These are undesirable due to mechanical complexity and added cost.

Accordingly, it is desirable to provide a water distributor for humidifiers or other similar evaporative apparatus which overcomes the numerous problems and drawbacks set forth above. It is also desirable to provide a humidifier which replaces the prior art distribution tray, and provides a better water distribution to the evaporative water panel.

SUMMARY OF THE INVENTION

It is one object of the present invention to provide a water distributor which eliminates the prior art trough-like distribution tray and pumice coating thereof.

It is also an object of the present invention to provide a water distributor which enables a consistent, even flow of water at a desired flow rate therethrough and a quicker response time in which water is delivered to the evaporative water panel.

It is a further object of the present invention to provide a water distributor which is capable of unplugging flow blockages caused by particles in the incoming water flow.

It is an additional object of the present invention to provide a water distributor employing tortuous flow channels designed for high flow resistance.

Another object of the present invention is to provide a water distributor which is improved in unit size, cost and manufacturability.

Yet a further object of the present invention is to provide a water distributor which is insensitive to unlevel mounting angles in the humidifier.

In one aspect of the invention, a water distributor provides a uniform supply of water at a desired flow rate to an evaporative panel held in a frame in an evaporative apparatus. The water distributor includes a base having a plurality of flow channels, each of the flow channels includes an inlet port for receiving water from a source, an outlet port for delivering water to the evaporative panel, and a tortuous path connecting the inlet port with the outlet port to provide high flow resistance, so as to facilitate the consistent and even flow of water through each of the outlet ports. The base is comprised of an elongated, planar manifold and an elongated planar cover interconnected thereto. The water inlet is in communication with the water source and a header structure is in communication with the water inlet in each of the inlet ports. Each flow channel is configured in the shape of a square or star-shaped wave. The base is attached to the evaporative apparatus such that the outlet ports are positioned over the evaporative panel. A solenoid valve is interconnected with a water inlet fitting and the water inlet. In several of the embodiments, the base is attached to bosses depending from the evaporative apparatus. In another embodiment, the base has tabs formed thereon and the frame is formed with slots for receiving the tabs such that the base is supported from the frame.

In another embodiment, the base is provided with a tubular inlet extending from the water inlet. In yet another embodiment, a solenoid valve and water inlet assembly is attached directly to the base in communication with the water inlet. Yet another embodiment discloses a base which is provided with a filter and includes a groove for receiving an O-ring positioned between the water inlet and the water inlet fitting.

In another aspect of the invention, a water distributor is adapted to feed water uniformly at a controlled flow rate to an evaporative panel located therebelow. The water distributor includes a manifold having a length, a width and a thickness, and a water inlet at one end thereof, header structure in communication with the water inlet and extending along the length of the manifold, and an array of flow channels. Each of the flow channels has an inlet port connected with the header, an outlet port for delivering water to the evaporative panel and a tortuous path interconnecting the inlet port and the outlet port. A cover is attachable to the manifold. With this construction, water is supplied to the water inlet, the header structure and each of the inlet ports, flows with high resistance through each of the tortuous paths, and is delivered with a consistent and even flow at a controlled flow rate dependent on water pressure to each of the outlet ports for deposition onto the evaporative panel. The manifold and the cover are formed from a plastic material. Preferably, the array of flow channels is a group of six flow channels. In one embodiment, the array of flow channels is aligned in parallel. In another embodiment the array of flow channels is arranged in alternating fashion with some of the flow channels on one side of a longitudinal axis, and the other of the flow channels on the opposite side of the longitudinal axis, each of the outlet ports extending vertically through the thickness of the manifold. In several of the embodiments, each of the outlet ports are located along a side edge of the manifold. In some cases, a throttle resistor structure interconnects the water inlet with the header structure to improve control of flow rate. It may be that the throttle structure may take the form of an orifice upstream from the water inlet. In at least one embodiment, the cover and manifold are provided with a cooperating locator pin and hole arrangement. Also in another embodiment, the cover is integrally formed with a solenoid valve body receiving a stack of solenoid components. The cover and stack of solenoid components are retained together to form an assembly. The flow channels may take the form of a square or star-shaped wave.

Various other features, objects, and advantages of the invention will be made apparent from the following description taken together with the drawings.

BRIEF DESCRIPTION OF THE DRAWING

The drawings illustrate the best mode presently contemplated of carrying out the invention.

In the drawings:

FIG. 8A is an exploded, perspective view of a third alternative embodiment of the water distributor;

FIG. 8B is an assembled view of the water distributor of FIG. 8A;

FIG. 8C is a cross sectional view taken on line 8C—8C of FIG. 8A;

DETAILED DESCRIPTION OF THE INVENTION

Prior Art

Figure 1:
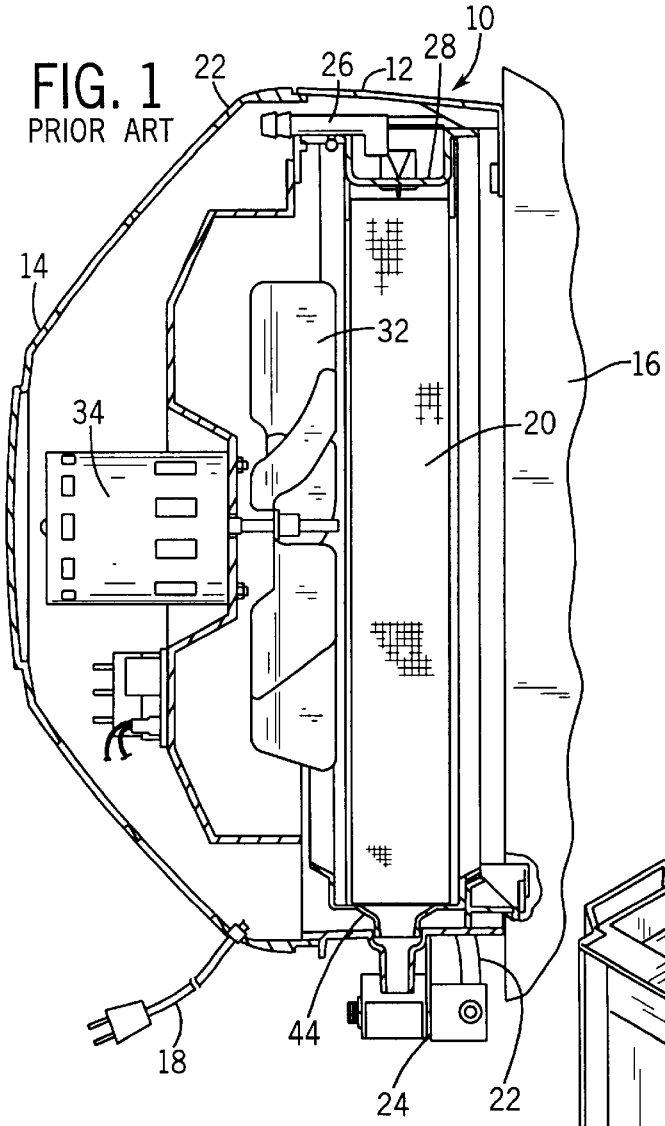
FIG. 1 PRIOR ART
FIG. 1 is a cross sectional view of a Prior Art humidifier.

Referring to FIG. 1, a Prior Art humidifier 10 includes a base portion 12 and a removable cover 14. Base portion 12 is connected to a warm air plenum 16 of a furnace system. A power cord 18 is connected through the bottom of the cover 14 and provides 120 volt AC power which is typically stepped down to 18 to 24 volts AC. An evaporative pad or water panel 20 is removably disposed within the base portion 12. A water feed tube 22 is connected to a solenoid valve 24 and supplies water via a nozzle 26 to a trough-like distribution tray 28. The water flows from distribution tray 28 through discharge openings 30 and down evaporative water panel 20. Air is forced through evaporative water panel 20 by a fan 32 driven by an electric motor 34 so as to evaporate the water on the panel 20. The humidified air is then delivered to the house, building, or heated space. Evaporative water panel 20 is held in a frame 36 within the base portion 12 in order to reduce the bypass around panel 20 and to contain the mineral deposits that build up on panel 20 as a result of the evaporative process.

Figure 2:
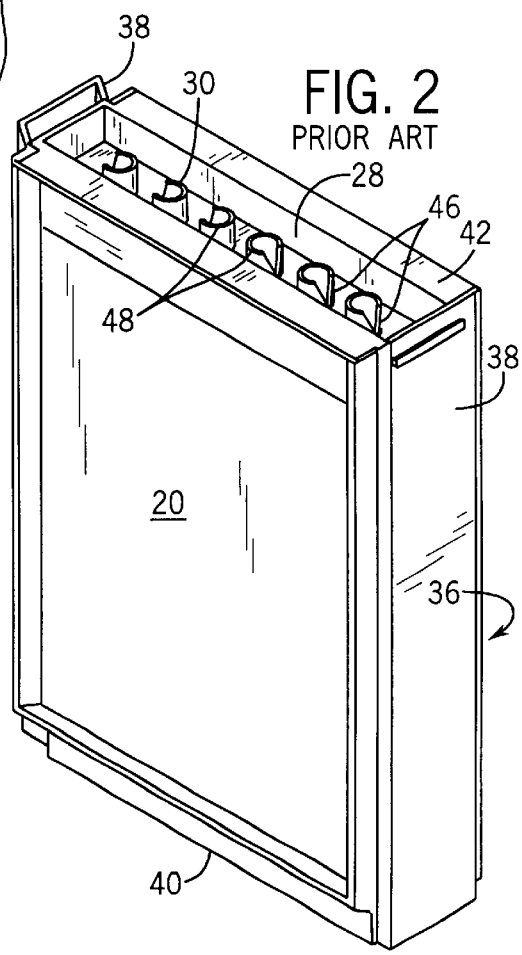
FIG. 2 PRIOR ART
FIG. 2 is a perspective view of a Prior Art evaporative water panel, frame and distribution tray used in the humidifier of FIG. 1.

As seen in FIG. 2, the Prior Art evaporative water panel frame 36 includes a pair of spaced apart side walls 38, an integral bottom portion 40 disposed between side walls 38, and a removable top portion 42. Bottom portion 40 is provided with a drain opening 44 through which excess water from the water panel 20 can be drained. Top portion 42 includes distribution tray 28 and its discharge openings 30 which are generally equally spaced therein. The length of the distribution tray 28 is substantially equal to the top edge of evaporative water panel 20. Discharge openings 30 are provided with V-shaped notches or weirs 46 formed by cylindrical risers 48. The weirs 46 are intended to evenly spread the water along the tops of the evaporative panel 20. The interior of the distribution tray 28 is typically coated with a spray adhesive and pumice powder for improving the evenness of water metering.

Figures 3, 4, 10:
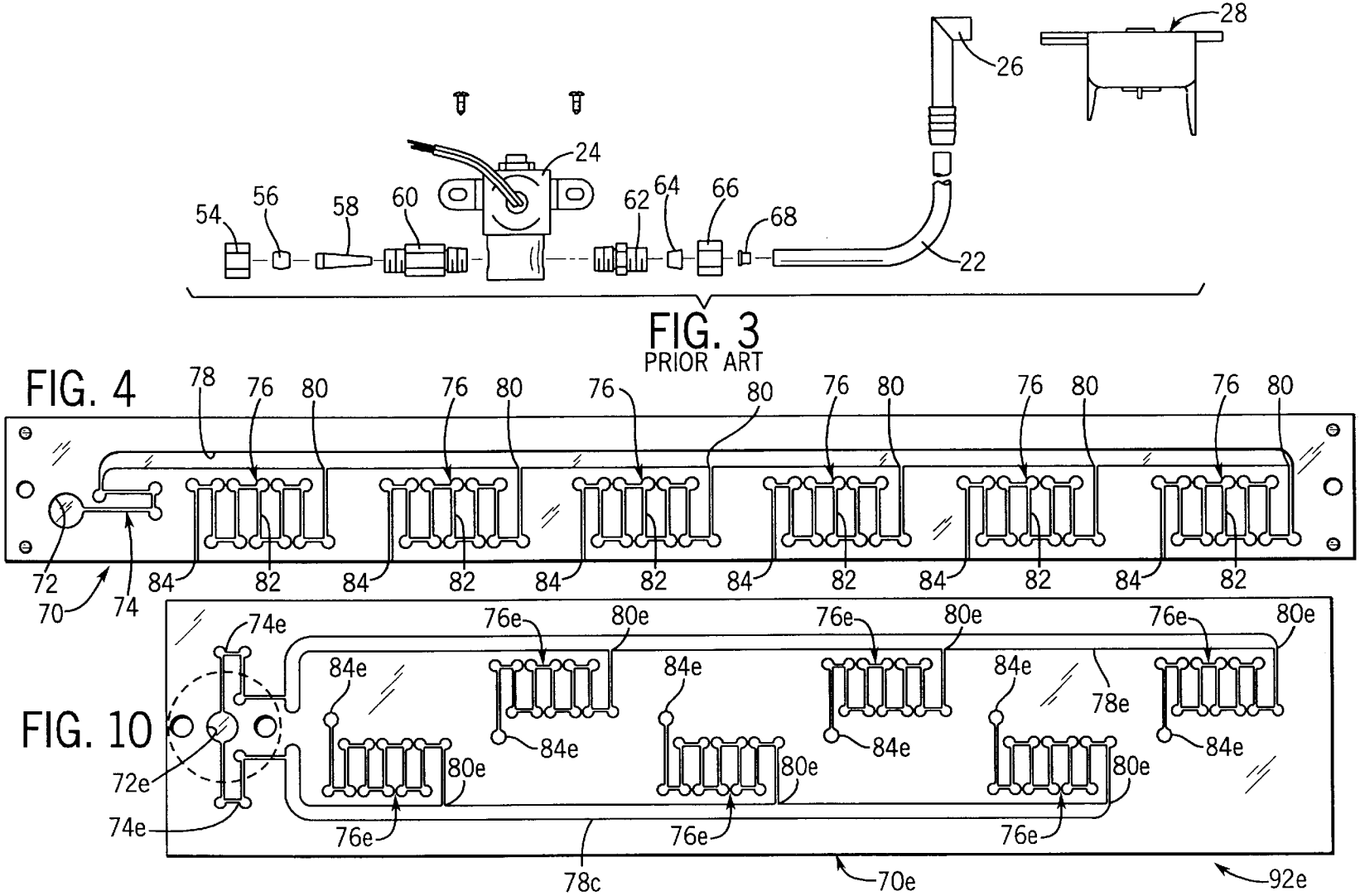
FIG. 3 PRIOR ART
FIG. 3 is an exploded view of a Prior Art water supply circuit as used in the humidifier of FIG. 1.
FIG. 4 is a plan view of a manifold of a water distributor embodying the present invention.
FIG. 10 is a plan view of a fifth alternative embodiment used in the water distributor.

FIG. 3 illustrates an exploded view of a Prior Art water supply circuit used in humidifier 10 and comprising solenoid valve 24, feed tube 22, nozzle 26 and distribution tray 28. Solenoid valve 24 includes a first nut 54, a brass sleeve 56, a strainer 58, an upstream fitting 60, a downstream fitting 62, a plastic sleeve 64, a second nut 66, and a small diameter orifice 68 which is positioned in the lower end of feed tube 22. It is this orifice 68 which regulates a low volume water flow rate to the distribution tray 28.

As set forth in greater detail in the Background of the Invention, uneven distribution of water from distribution tray 28 can lead to loss of wetted surface in the water panel 20 and further reduced evaporation. It is the present invention which eliminates the pumice coating of humidifier components, and markedly improves the design of the distribution tray 28 to provide better water distribution to and evaporation from the water panel 20.

The Present Invention

In one embodiment, the distribution tray 28 is replaced by a water distributor manifold 70, FIG. 4, typically in the form of a flat, rectangular plastic bar or plate, such as acrylic, measuring, for example, ten inches in length, one inch in width, and three-sixteenth inches in depth. The plate 70 has a feed tube or water inlet entrance 72, an optional throttle resistor 74 and a series or array of spaced apart, flow channels 76 formed therein such as by machining or molding. Water delivered through entrance 72 is introduced to the throttle resistor 74, a bent passageway of tortuous construction designed to partially drop the water system line pressure of 40 to 60 psi about 75%, so that the flow channel 76 will fit on the one inch wide bar. The throttle resistor 74 has a larger passage than a prior art orifice 68 so that the risk of particle blockage is lower and the orifice 68 is eliminated. Upon exiting the throttle resistor 74, the water enters an elongated header 78 which runs substantially along the length of the bar 70. The header 78 supplies water to six parallel, identical flow channels 76, each of which is made with an inlet port 80 in communication with a square wave, tortuous path 82, so that flow resistance is high and the flow rate of the water is controlled even though the cross sectional area of the flow channel 76 is greater than the prior art orifice 68. This design is intended to allow easier manufacture of parts that provide substantially consistent and even water flow from an outlet port 84 in each flow channel 76. Each outlet port 84 opens to one side of the manifold 70. The manifold 70 with its flow channels 76 provides a water circuit plate. It should be understood that the tortuous path 82 in each flow channel 76 is not limited to a square wave path, but may be formed of various shapes which may provide more turbulence in a shorter path or allow larger channel cross section. If size of the manifold 70 is not limiting, it is not necessary to have a throttle resistor 74. That is, in its broadest form, water supplied through entrance 72 flows directly into header 78 and into flow channels 76.

Figures 5A, 5B:
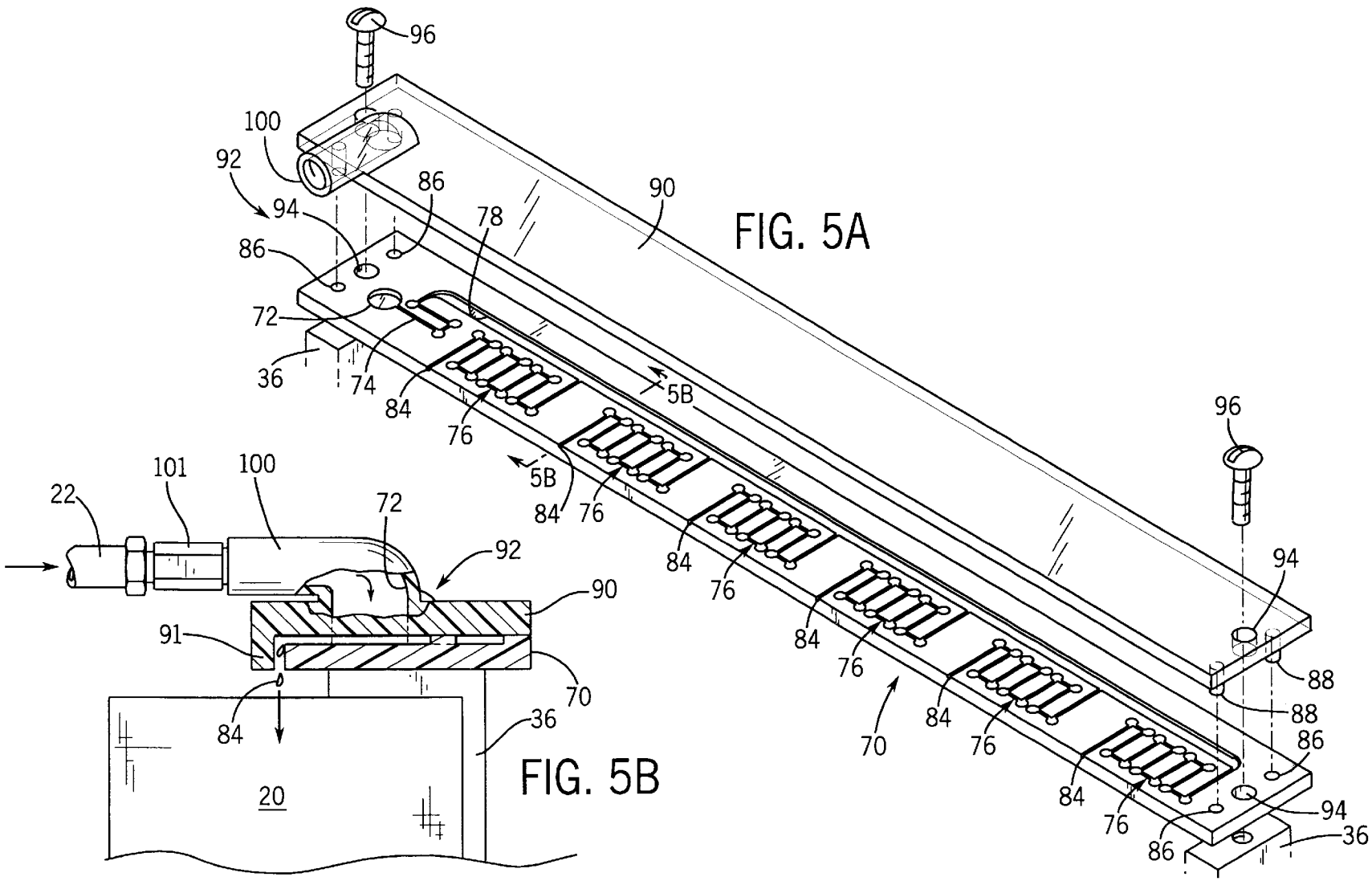
FIG. 5A is an exploded, perspective view of a water distributor employing the manifold of FIG. 4.
FIG. 5B is a cross sectional view of the mounting of the water distributor of FIG. 5A in a humidifier.

Turning to FIG. 5A, the manifold 70 may be formed with locator holes 86 for receiving cooperating pins 88 formed on the bottom of a flat, rectangular plastic cover plate 90 which is secured such as by epoxy bonding, over the flow channels 76 and the flow manifold. Cover plate 90 includes a deflector lip 91 so that water will exit outlet 84 as downward drips of water not as a small jet at a normal flow rate. The combination of the manifold 70 and the cover plate 90 forms an elongated, planar base and defines a water distributor 92 embodying the present invention. Aligned holes 94 are provided in both the manifold 70 and cover plate 90 for receiving fasteners 96 used to attach water distributor 92 to the top of frame 36. Cover plate 90 is provided with a tubular inlet 100 which connects feed tube entrance 72 with the feed tube 22 in a pressure type connection 101.

Figure 6A:
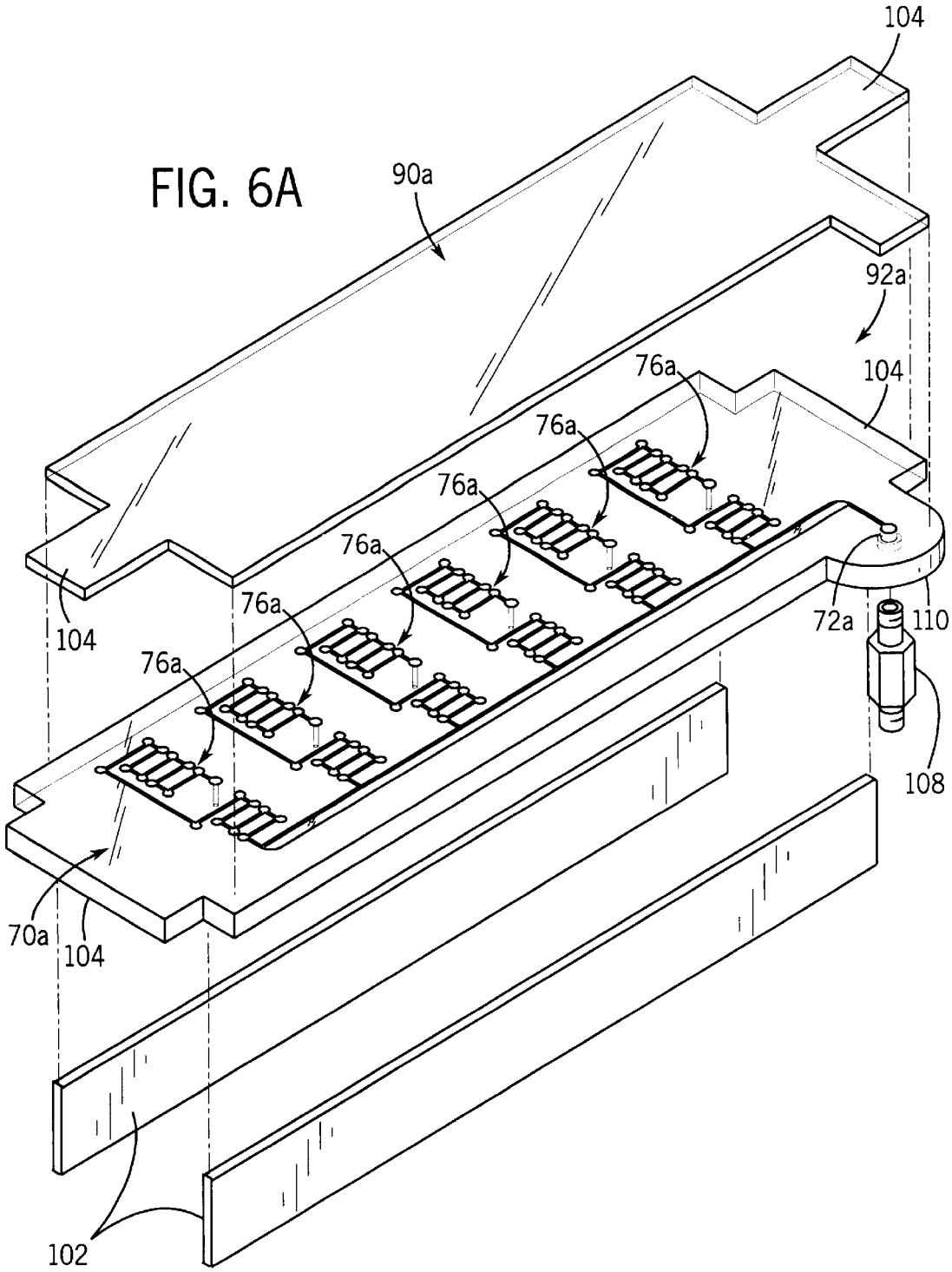
FIG. 6A is an exploded, perspective view of a first alternative embodiment of the water distributor.
Figures 6B, 6C:
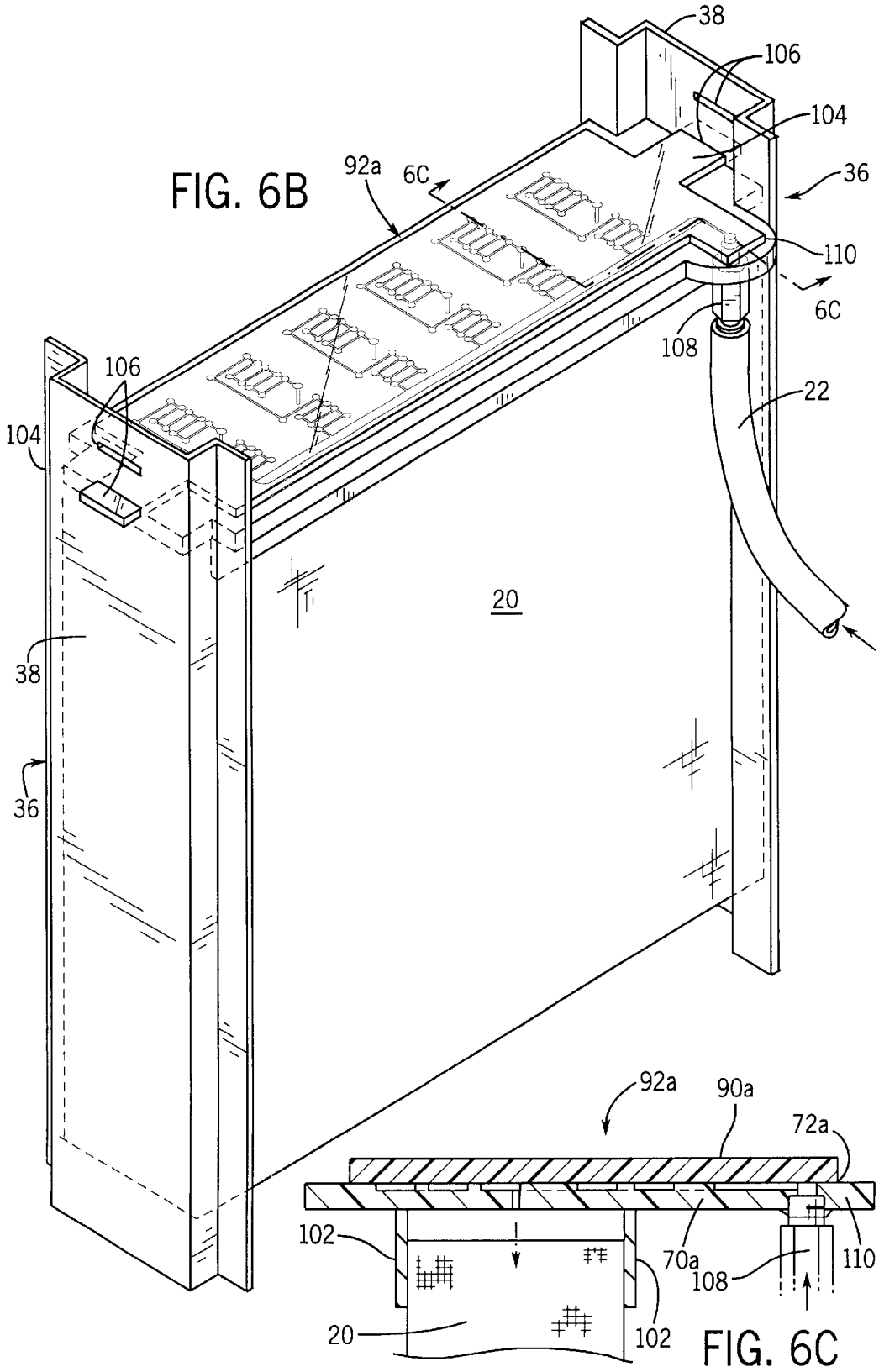
FIG. 6B is a perspective view showing the mounting of the water distributor of FIG. 6A and a water panel frame.
FIG. 6C is a cross sectional view taken on line 6C—6C in FIG. 6B.

One alternative embodiment to the water distributor 92 is shown in FIGS. 6A, 6B and 6C, which illustrate a manifold 70*a* having a feed tube entrance 72*a*, flow channels 76*a* and a pair of parallel depending air bypass flanges 102 for retaining the top edges of evaporative water panel 20 in frame 36. Both the manifold 70*a* and cover plate 90*a* forming water distributor 92*a* are provided with end tabs 104 adapted to fit in slots 106 formed in side walls 38 of frame 36. A brass fitting 108 is used to interconnect feed tube 22 with feed tube entrance 72*a* located in a laterally projecting ear 110.

Figure 7A:
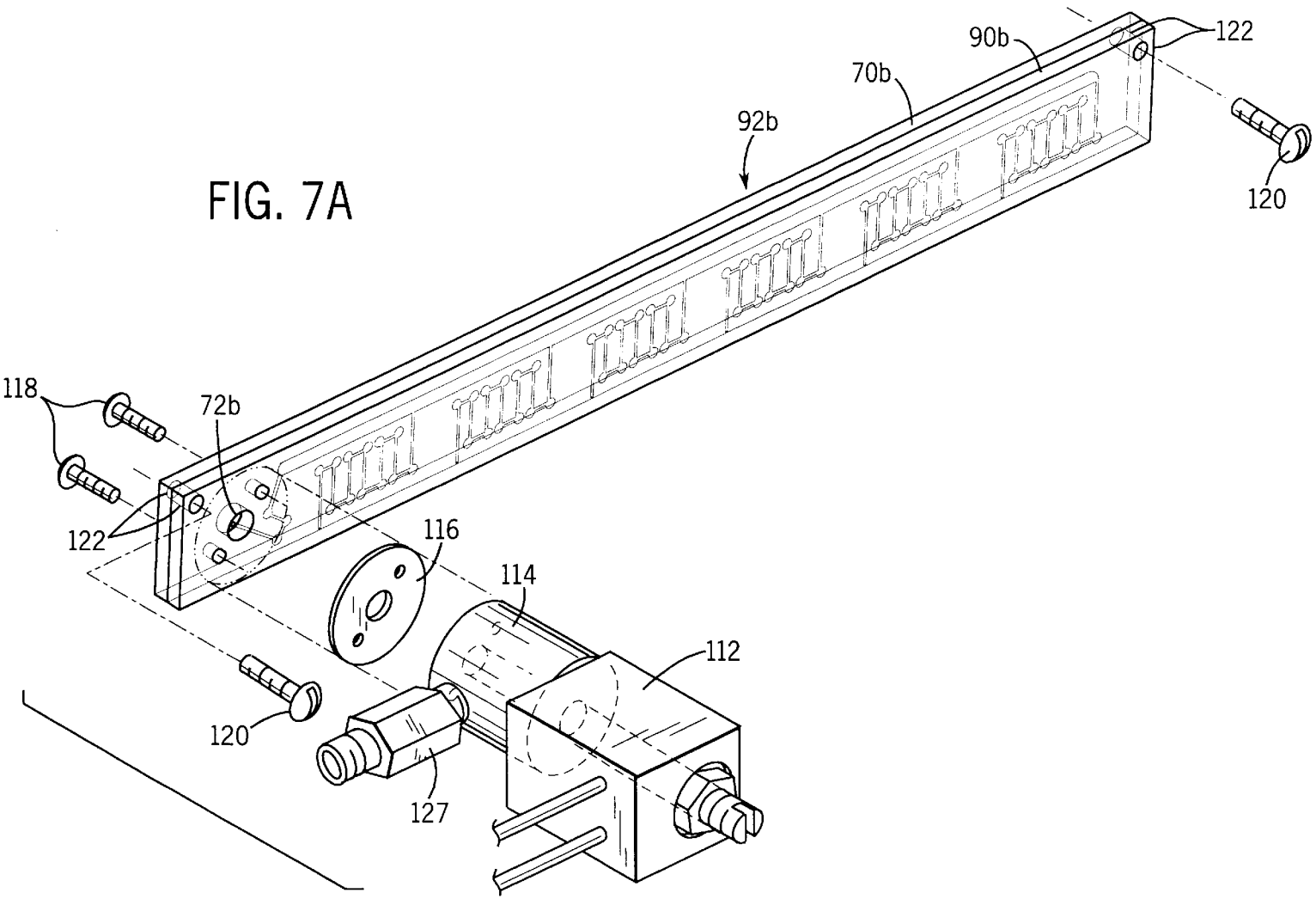
FIG. 7A is an exploded, perspective view of a second alternative embodiment of the water distributor.
Figure 7B:
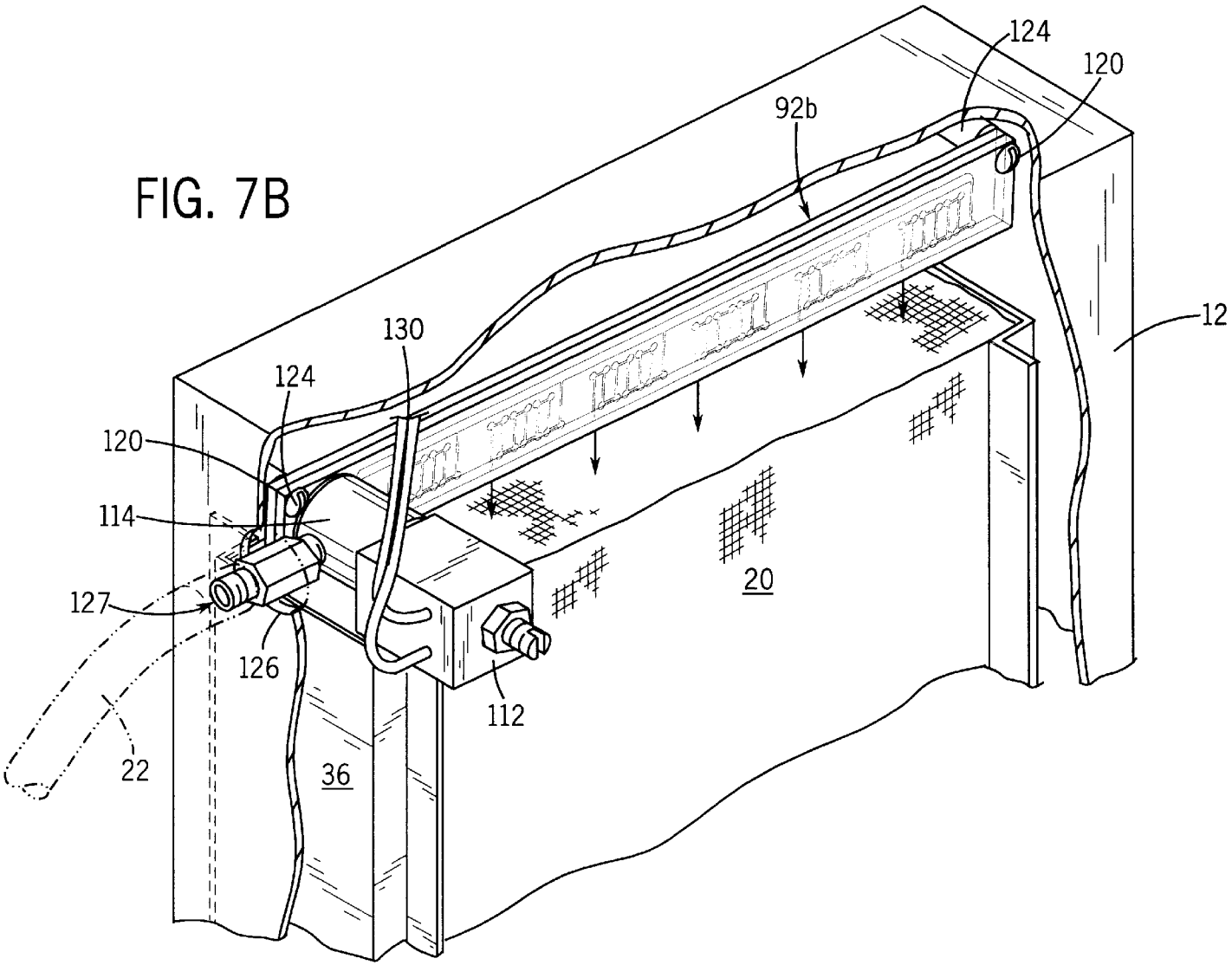
FIG. 7B is a perspective view of the mounting of the water distributor of FIG. 7A in a humidifier.

A second alternative embodiment shown in FIGS. 7A and 7B is comprised of a water distributor 92*b* having solenoid valve 112 and water inlet fitting 114 mounted directly thereon with a rubber gasket 116 seated in the feed tube entrance 72*b*, and a pair of screws 118 passing through holes in the water distributor 92*b* and holes in gasket 116 and holes at the bottom of the fitting 114. The combination water distributor/solenoid valve assembly is installed in the interior or top of the humidifier base portion 12 by passing a pair of screws 120 through mounting holes 122 in the corners of the water distributor 92*b* and into the bosses 124 formed on the base portion 12. A hole 126 is formed in the side wall of the base portion 12 for reception of the water inlet 127 on fitting 114. This is a particularly attractive embodiment in which direct mounting of the solenoid valve 112 and water inlet fitting 114 to the water distributor 92*b* eliminates the prior art feed tube 22, nozzle 26, orifice 68, brass fitting 62, plastic sleeve 64 and nut 66, and thus saves cost and reduces points of potential leaks. This design results in less costs in humidifier housing, packaging and shipping and allows installation in tighter spaces.

A third alternative embodiment illustrated in FIGS. 8A, 8B and 8C, combines the concept of mounting the solenoid valve 112 directly to the water distributor 92*c* with the concept of molding a portion 132 of solenoid valve 112 directly into the distributor cover plate 90*c*. As seen in FIG. 8A. the cover plate 90*c* includes an integrally molded valve body 132 having a laterally projecting water inlet 134 leading to a water source. Cover plate 90*c* is joined such as by solvent welding to manifold 70*c* with flow channels 76*c*. The valve body 132 receives in stacked formation, O-ring 138, spring 140, plunger 142, core 144, over-molded coil 146 and a nut 148.

Figure 9B:
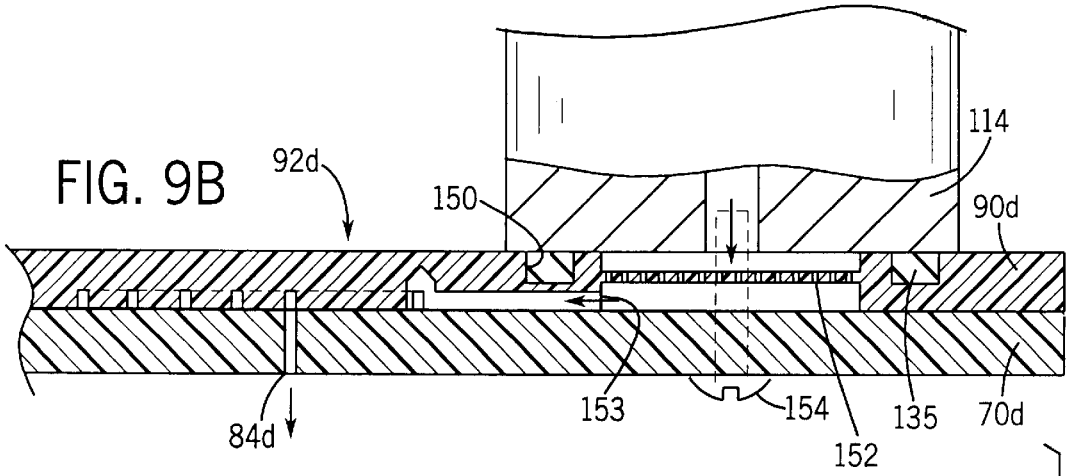
FIG. 9B is a cross sectional view of the water distributor of FIG. 9A in an assembled form.
Figure 9A:
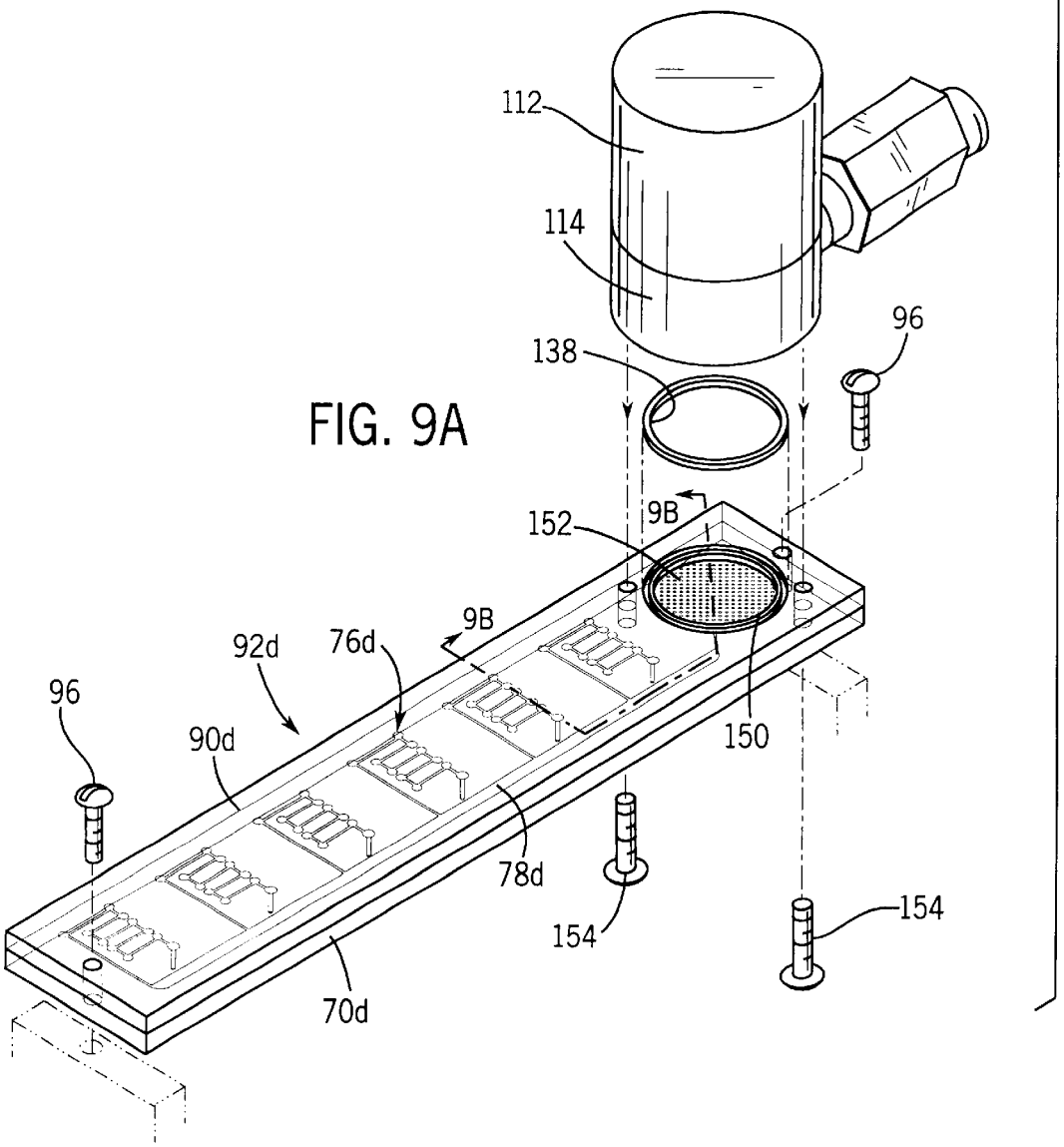
FIG. 9A is an exploded, perspective view of a fourth alternative embodiment of the water distributor.

A fourth alternative embodiment shown in FIGS. 9A and 9B addresses the problems of large particles shed from the solenoid valve 112 which have a tendency to clog the water distributor 92*d*. Such particles, typically comprised of brass, rubber, steel or plastic, are created during part machining or from friction during assembly. Dirt may also enter parts from handling during assembly or shipping. In this version, the cover plate 90*d* is provided with an O-ring groove 150 which surrounds a conventional, circular particle filter 152 having holes smaller than those forming the flow channels 76*d*. Filter 152 is placed in an opening 153 formed in cover plate 90*d*, the opening 153 being in communication with header 78d on manifold 70*d*. Filter 152 captures any residual particles exiting from the solenoid valve 112/water inlet fitting 114. With the cover plate 90*d* secured in position, O-ring 138 is placed in the groove 150. Solenoid valve 112/water inlet fitting 114 has an outlet on the bottom thereof which is placed over the O-ring 138 and filter 152 and fastened by a pair of screws 154 which pass through the water distributor 92*d* and are threaded into the base of the solenoid valve assembly 112,114.

A fifth alternative embodiment is shown in FIG. 10 and further addresses the problem of internal blockage due to particles from the solenoid valve assembly. In this design, manifold 70*e* is divided into two independent groups of ports. More particularly, the inlet from the solenoid valve assembly 112,114 is split into two opposed throttle resistors 74*e* and into respective headers 78*e* on each side of the manifold 70*e*. One header 78*e* feed three inlet ports 80*e*, flow channels 76*e* and outlet ports 84*e* on one side of manifold 70*c*. The other header 78*e* feeds an additional three inlet ports 80*e*, flow channels 76*e* and outlet ports 84*e* which are located on the other side of the manifold 70*c* and are interspaced in alternating fashion from their companion inlet ports 80e, flow channels 76*e* and outlet ports 84*e*. With this construction, the chances of two throttle resistors 74*e* becoming blocked is lower than one resistor. Outlet ports 84*e* of each group extend vertically through the manifold 70*e* and are interposed so water is still delivered to most of the water panel 20 if one group becomes blocked. The outlet ports 84*e* have larger diameter holes than the flow channels 76*e* so as to break down the jet exiting the flow channel 76*e* into lower velocity drips.

In each embodiment described above, water delivered to the feed tube entrances 72*a–e* passes through the resistor structure 74*a–e* (if any), and header structure 78*a–e*, and then flows into the inlet port 80*a–e* of each flow channel 76*a–e* along the particular tortuous path 82*a–e*. The resulting water flow to each of the outlet ports 84*a–e* provides an adequate water supply which is directed onto the top of the water panel 20 and flows downwardly to evenly cover the panel 20. Air is forced by a motor-driven fan 32 through water panel 20 so as to evaporate the water in the panel 20 and deliver humidified air to the surrounding building structure.

With the water distributor 92*a–e* of the present invention, the flow channels 76*a–e* have small volume. As a result, water distribution is obtained nearly instantaneously as soon as the humidifier 10 is turned on, whereas the prior art humidifier with distribution tray 28 took about thirty seconds to fill before water would flow to the water panel 20.

It should also be appreciated that the flow channels 76*a–e* are molded or machined accurately in a plastic component resulting in uniform flow from each outlet port 84*a–e*. Since each outlet port 84*a–e* operates at line pressure, the control force is several orders of magnitude higher than other influencing forces such as water depth, surface tension, and capillary force. This results in uniform output no matter what orientation the distributor 92*a–e* is mounted in. Installer care would be less important in humidifier performance. Because resistance develops in a long path, the cross sectional area of the flow channels 76*a–e* is many times that of a traditional orifice with small hole. It is less likely a particle will block the channel. Since the design allows many independent flow paths, total blockage of water is less likely and water flows remains more even. If one port of the new concept is blocked, the pressure and flow rate of the other ports remains constant and most of the humidifier performance is retained. Unlike the prior art distribution tray, there is some potential that a blocked port will reopen. As mentioned above, when a weir stops flowing, very little pressure builds to restart it. In the present invention, if a blockage would occur in the flow channel 76*a–e*, or maybe mineral deposits begin to block the outlet port 84*a–e*, full line pressure will build up behind the blockage and may reopen the flow channel 76*a–e*. All of these advantages result in a more reliable and uniform water flow to the water panel and better humidifier performance.

It should likewise be understood that there are many ways to shape the tortuous path, flow channels 76*a–e* so as to provide more turbulence in a shorter path or allow larger flow channel cross section. With respect to the manufacturing of the water distributor 92*a–e*, injection molding thermoplastic appears to be a preferred manufacturing method. However, other methods such as thermoforming may be possible. Joining the components may be by mechanical screws or rivets with a gasket between parts or direct bonding via solvent or ultrasonic welding, tape adhesive bonding, or epoxy. If parts are secured by screws, then they might be disassembled to clear blockages. Some bonded constructions may have a low enough cost to be disposable. Then, mineral buildup or blockage is less of an issue since the water distributor 92*a–e* could be replaced along with the water panel 20.

Figure 11:
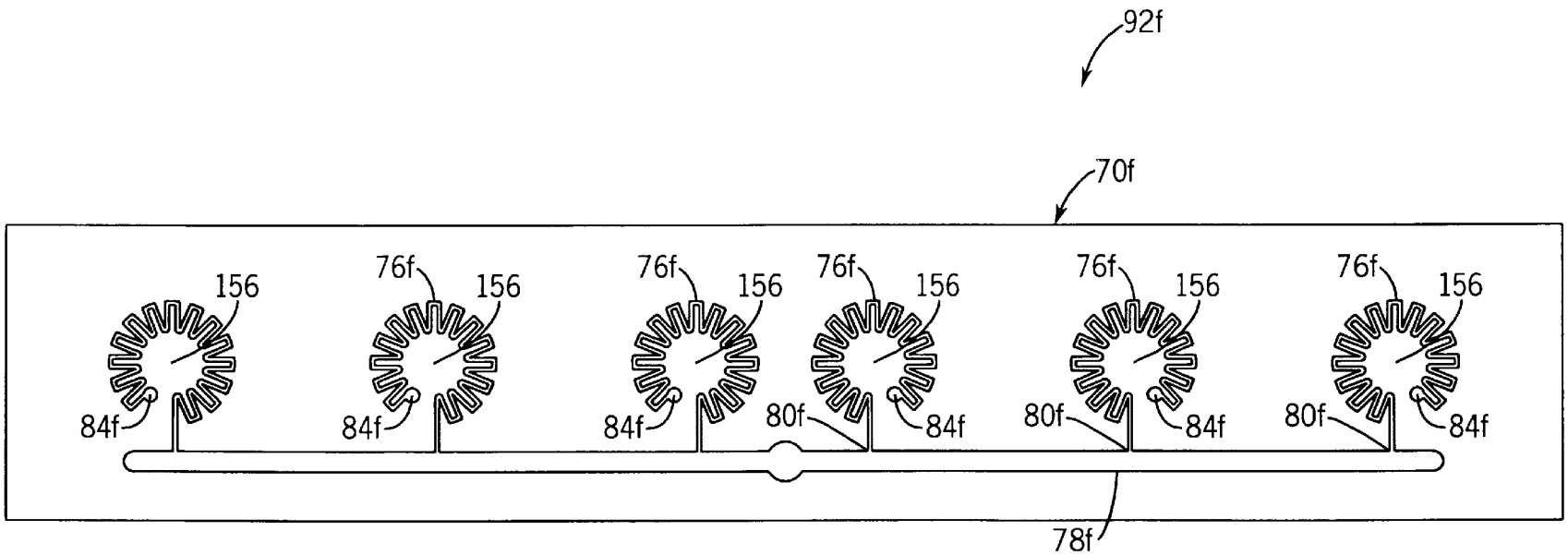
FIG. 11 is a plan view of a sixth alternative embodiment used in the water distributor.

A sixth alternative embodiment of water distributor 92*f*, shown in FIG. 11, has a manifold 70*f* provided with a group of six spaced apart, tortuous path, flow channels 76*f* which are in the form of a star-shaped wave surrounding a central core 156. Each of the flow channels 76*f* is fed by inlet header 78*f* to a respective inlet port 80*f* and water flows to a respective outlet 84*f*. This design works best in conjunction with upstream orifice 68.

Unlike the Prior Art distribution tray 28, there is no need to pumice-coat or endure uneven water distribution in the water distributor 92*a–f* which is of higher quality yet of lower cost than the known system.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with the following claims.

What is claimed is:

1. A water distributor for providing a uniform supply of water at a desired flow rate to an evaporative panel held in a frame of an evaporative apparatus, the water distributor comprising:

a base having a plurality of flow channels, each of the flow channels including an inlet port for receiving water from a source, an outlet port for delivering water to the evaporative panel, and a tortuous path connecting the inlet port with the outlet port for providing high flow resistance so as to facilitate the consistent and even flow of water at a desired flow rate through each of the outlet ports.

2. The water distributor of claim 1, wherein the base is comprised of an elongated planar manifold and an elongated planar cover connected thereto.

3. The water distributor of claim 1, including a water inlet in communication with the water source and a header structure in communication with the water inlet and each of the inlet ports.

4. The water distributor of claim 1, wherein each flow channel is configured in the shape of a square wave.

5. The water distributor of claim 1, wherein each flow channel is in the shape of a star-shaped wave.

6. The water distributor of claim 1, wherein the base is attached to the evaporative apparatus such that the outlet ports are positioned over the evaporative panel.

7. The water distributor of claim 3, including a solenoid valve interconnected with a water inlet fitting and the water inlet.

8. The water distributor of claim 6, wherein the base is attached to bosses depending from the evaporative apparatus.

9. The water distributor of claim 6, wherein the base has tabs formed thereon and the frame is formed with slots for receiving the tabs such that the base is supported from the frame.

10. The water distributor of claim 3, wherein the base is provided with a tubular inlet extending from the water inlet.

11. The water distributor of claim 3, wherein a solenoid valve and water inlet assembly are attached directly to the base in communication with the water inlet.

12. The water distributor of claim 7, wherein the base is provided with a filter and includes sealing means positioned between the water inlet and the water inlet fitting.

13. A water distributor adapted to feed water uniformly at a controlled flow rate to an evaporative panel located therebelow comprising:

a manifold having a length, a width, and a thickness and including a water inlet, header structure in communication with the water inlet and extending along the length of the manifold, and an array of flow channels, each of the flow channels having an inlet port connected with the header, an outlet port for delivering water to the evaporative panel and a tortuous path interconnecting the inlet port and the outlet port, whereby water is supplied to the water inlet, the header structure and each of the inlet ports, flows with high resistance through each of the tortuous paths, and is delivered with a consistent and even flow at a desired flow rate to each of the outlet ports for deposition on the evaporative panel.

14. The water distributor of claim 13, wherein the manifold formed of a plastic material.

15. The water distributor of claim 13, wherein the array of flow channels is a group of six flow channels.

16. The water distributor of claim 13, wherein the array of flow channels is aligned in parallel.

17. The water distributor of claim 13, wherein the array of flow channels is arranged in alternating fashion with some of the flow channels on one side of a longitudinal axis and the other of the flow channels on the opposite side of the longitudinal axis, each of the outlet ports extending vertically through the thickness of the manifold.

18. The water distributor of claim 13, wherein each of the outlet ports is located along a side edge of the manifold.

19. The water distributor of claim 13, including an orifice upstream of the water inlet.

20. The water distributor of claim 13, including throttle resistor structure having a tortuous path construction interconnecting the water inlet with the header structure.

21. The water distributor of claim 13, wherein the manifold is integrally formed with a solenoid valve body receiving a stack of solenoid components retained together to form an assembly.

22. The water distributor of claim 15, wherein the flow channels are in the form of a square wave.

23. The water distributor of claim 15, wherein the flow channels are in the form of a star-shaped wave.

* * * * *